United States Patent [19]

Tanaka et al.

[11] 4,376,578

[45] Mar. 15, 1983

[54] ELECTROGRAPHIC COPYING MACHINE OF POWDER IMAGE TRANSFER TYPE

[75] Inventors: Susumu Tanaka; Tateki Oka, both of Toyokawa, Japan

[73] Assignee: Minolta Camera Kabushiki Kaisha, Osaka, Japan

[21] Appl. No.: 307,661

[22] Filed: Oct. 1, 1981

[30] Foreign Application Priority Data

Oct. 7, 1980 [JP] Japan ..... 55-140790

[51] Int. Cl.[3] ..... G03G 21/00

[52] U.S. Cl. ..... 355/15; 15/256.5; 118/652; 355/3 DD

[58] Field of Search ..... 355/3 DD, 15; 118/652, 118/653-658; 15/1.5, 256.5, 256.51, 256.52

[56] References Cited

U.S. PATENT DOCUMENTS

| | | | |
|---|---|---|---|
| 3,678,896 | 7/1972 | Hewitt | 355/15 X |
| 4,011,835 | 3/1977 | Lewis | 355/3 DD |
| 4,323,306 | 4/1982 | Ito et al. | 355/15 |
| 4,325,628 | 4/1982 | Torigai et al. | 355/15 |

FOREIGN PATENT DOCUMENTS

| | | |
|---|---|---|
| 54-30832 | 3/1979 | Japan . |
| 55-45012 | 3/1980 | Japan . |

*Primary Examiner*—R. L. Moses

*Attorney, Agent, or Firm*—Wenderoth, Lind & Ponack

[57] ABSTRACT

An electrographic copying machine of the powder image transfer type in which a channel for transporting the developer recovered by a cleaner to a developing unit includes an assembly for removing foreign matter from the developer. The developing unit is adapted to develop latent electrostatic images with a magnetic developer which is a mixture of finely divided insulating toner and a magnetic carrier having small size particles and a resistivity of at least $10^{13}$ ohm-cm. The assembly has a nonmagnetic hollow cylindrical member for guiding the developer, a magnetic transport member disposed within the cylindrical member for transporting the developer, a foreign matter removal opening formed in the lower wall of the cylindrical member, and magnets for forming a magnetic field for attracting the magnetic carrier contained in the portion of the developer positioned in the vicinity of the opening upwardly in the cylindrical member.

5 Claims, 3 Drawing Figures

ELECTROGRAPHIC COPYING MACHINE OF POWDER IMAGE TRANSFER TYPE

BACKGROUND OF THE INVENTION

The present invention relates to an electrographic copying machine of the powder image transfer type wherein the magnetic developer recovered by a cleaner is reused for developing latent electrostatic images.

One type of such copying machines which are widely used are machines comprising a magnetic brush developing unit by which latent electrostatic images formed on the surface of an image bearing member are developed with a magnetic developer composed of a magnetic carrier and an insulating toner mixed therewith, i.e. a so-called two-component magnetic developer.

In this type of copying machine, only the insulating toner from the two-component magnetic developer is deposited on the surface of the image bearing member and is used for developing the latent electrostatic image to a toner image. However, part of the toner is wasted and does not contribute to the formation of the copy image since the portion of the toner deposited on the surface of the image bearing member but remaining thereon without being transferred to the copy paper is collected by a cleaner and discarded.

To eliminate the waste of the insulating toner to make its use more efficient, a method has been proposed in which the toner collected by the cleaner is guided into the magnetic brush developing unit and reused for developing latent electrostatic images. While waste of the toner is avoided by this method, the copying machine adapted for carrying out the method has the following problem.

When the insulating toner is collected by the cleaner, dust, including fibers of the copy paper and the like, adhering to the surface of the image bearing member is also collected at the same time, with the result that such dust is led into the developing unit along with the toner. Additionally, the collected toner itself contains toner particles charged with a polarity opposite to the desired polarity, for example, by the influence of the transfer corona charger, and also agglomerates of several toner particles which are fused together. The proportion of agglomerates of toner contained in the collected toner is especially high in copying machines wherein the cleaner has a cleaning blade for scraping the residual toner from the surface of the image bearing member. Although such charged toner particles and agglomerated toner particles are no longer suitable for developing latent electrostatic images, such toner particles are nevertheless led into the developing unit just as is the dust. Accordingly, while the copying machine adapted for carrying out the above method operates longer so as to make an increased number of copies, the dust and the toner particles unsuited for developing latent images (hereinafter referred to collectively as "foreign matter") are accumulated in the developer within the developing unit. Consequently the developer produces marked noise, such as black or white spots or fog, in the copy images formed.

It is therefore essential to overcome the above problem in order to make the foregoing method feasible for use in electrographic copying machines of the powder image transfer type.

SUMMARY OF THE INVENTION

The main object of the present invention is to provide a novel and useful electrographic copying machine of the powder image transfer type.

Another object of the invention is to provide an electrographic copying machine of the powder image transfer type having a foreign matter removing assembly which has a simple construction.

Still another object of the invention is to provide an electrographic copying machine of the powder image transfer type which employs the foregoing method and in which the developer nevertheless remains free from foreign matter so as to be able to produce satisfactory copy images at all times.

The above and other objects of the present invention are fulfilled by providing an electrographic copying machine of the powder image transfer type comprising: a magnetic brush developing unit having a developing electrode in its interior for developing a latent electrostatic image on the surface of an image bearing member with a magnetic developer which is a mixture of a toner having insulating properties and a magnetic carrier having small particle sizes and having a resistivity of at least $10^{13}$ ohm-cm; a developing bias voltage source for applying to the developing electrode a developing bias voltage sufficient for electrostatically depositing the magnetic carrier of the magnetic developer on the surface of the image bearing member in corresponding relation to the background area of the latent electrostatic image during the development of the latent image; a toner image transfer unit for selectively transferring to the surface of copy paper only the insulating toner adhering to the surface of the image bearing member in corresponding relation to the image area of the latent image and contained in the magnetic developer electrostatically deposited on the surface of the image bearing member by the development of the latent image; a cleaner for removing and recovering from the surface of the image bearing member the magnetic developer remaining on the surface after the transfer of the insulating toner; a non-magnetic hollow cylindrical member disposed at least partly in an approximately horizontal position for guiding the magnetic developer recovered by the cleaner into the magnetic brush developing unit; a magnetic transport member disposed within the hollow cylindrical member for transporting the magnetic developer toward the developing unit; a foreign matter removal opening formed in the lower wall of the approximately horizontal portion of the hollow cylindrical member; and magnets for forming a magnetic field for attracting inwardly of the hollow cylindrical member the magnetic carrier contained in the portion of the magnetic developer positioned in the vicinity of the removal opening; whereby during the course of transport of the magnetic developer recovered by the cleaner toward the developing unit, foreign matter in the magnetic developer is caused to fall through the opening.

Stated more specifically the magnetic developer comprises a finely divided magnetic carrier material having average particle size of 10 to 30 $\mu$m and a finely divided insulating toner material having an average particle size smaller than that of said magnetic carrier material. The insulating toner is substantially nonmagnetic and the particles are triboelectrically charged to a polarity opposite to that of the latent electrostatic image when brought into frictional contact with the particles of the magnetic carrier. The developing bias voltage has the same polarity as that of the latent electrostatic image and has a value higher than the potential of the background area of the latent image. The toner image transfer unit comprises a d.c. corona discharge unit having the same polarity as the latent image. The magnetic transport member comprises a magnetic coil spring which is drivingly rotatable.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE INVENTION

Figure 1:
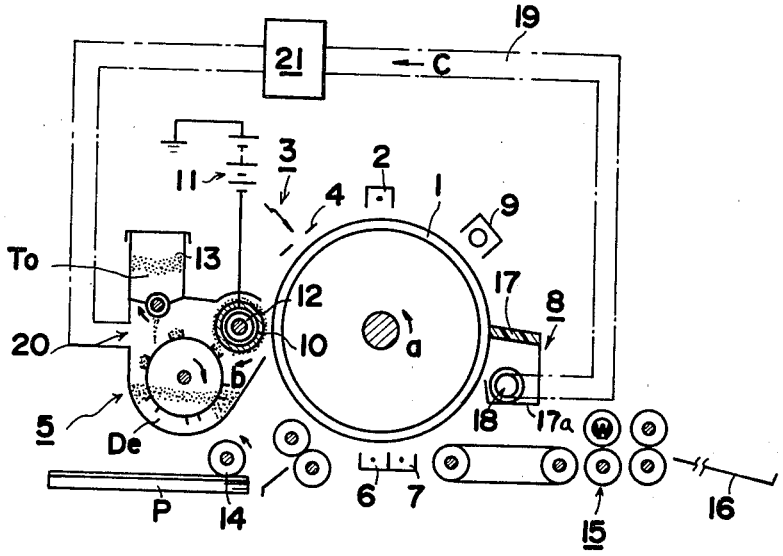
FIG. 1 is a diagram schematically showing the interior construction of an electrographic copying machine of the powder image transfer type incorporating the present invention.

FIG. 1 is a diagram schematically showing the interior construction of an electrographic copying machine of the powder image transfer type incorporating the present invention.

With reference to FIG. 1, an electrophotographic photoconductive drum 1 in the form of an aluminum drum is coated over its outer periphery with a composition comprising a finely divided photoconductive material, e.g. $CdS \cdot nCdCO_3$ ($0<n\leqq 4$), and a binder resin. During a copying operation, the drum 1 is rotated at a peripheral speed of 110 mm/sec in the direction of arrow a by unillustrated drive means. During this rotation, a copy image is formed on the surface of the copy paper P to be described later in corresponding relation to the image of an original placed on an unillustrated document carriage. For this purpose, the drum 1 is surrounded by a sensitizing charger 2, slit 4 of an optical system for projecting images, magnetic brush developing unit 5, transfer charger 6, transfer paper separating charger 7, cleaner 8 and eraser lamp 9 which are arranged in succession in the direction of arrow a. The eraser lamp 9 is adapted to illuminate the surface of the drum 1 uniformly before the subsequent formation of a latent electrostatic image to optically attenuate and eliminate the charges remaining on the surface.

The surface of the photoconductive drum 1 is uniformly charged by the sensitizing charger 2. The image projecting optical system 3 continuously projects an optical image corresponding to the image of the original through the slit 4 onto the surface of the drum 1 during rotation of the drum. Accordingly a latent electrostatic image corresponding to the image of the original is formed on the surface of the drum 1. The potential applied to the drum 1 by the sensitizing charger 2 and the amount of light applied to the drum 1 by the optical system 3 are individually so adjusted that the image areas (corresponding to the black areas of the original) of the latent image thus formed have a potential of −550 V and that the background areas of the image (corresponding to the blank areas of the original) have a potential of −200 V.

The latent electrostatic image on the surface of the drum 1 is developed by the magnetic brush developing unit 5 with a two-component magnetic developer De which is a mixture of particles of a magnetic carrier having a resistivity of $10^{14}$ ohm-cm, an average particle size of 20 μm, and particles of a toner of a non-magnetic insulating material having a resistivity of at least $10^{15}$ ohm-cm and an average particle size of 11 μm. The carrier-to-toner weight ratio is 9:1. The two-component magnetic developer De is described in detail in U.S. Pat. No. 4,284,702, in the name of Kenji Tabuchi et al. The developing unit 5 has in its interior a developing sleeve 10 which functions as a developing electrode. The developing sleeve 10 is opposed to, and spaced by a gap of 0.7 mm from, the surface of the drum 1 which is drivingly rotated in the direction of arrow a with the latent image supported thereon. The developing sleeve 10 is made of an electroconductive nonmagnetic material, e.g. stainless steel, and is drivingly rotated at a low speed in the direction opposite to arrow b during development of latent electrostatic images. The developing sleeve 10 has in its interior a magnetic roller 12 which is drivingly rotated at a high speed in the direction opposite to allow b during development of latent images. During the development of latent images, the developer De is conveyed in the direction of arrow b along the periphery of the developing sleeve 10 by the magnetic conveying action of the magnetic roller 12. The roller 12 has eight magnetic poles which produce a magnetic force of 1000 G on the surface of the developing sleeve 10.

The developing sleeve 10 is electrically connected to a developing bias voltage source 11 for applying to the sleeve 10 a developing bias voltage of −300 V which is sufficient for electrostatically depositing the magnetic carrier of the developer De on the surface portions of the drum 1 corresponding to the background areas of the latent electrostatic image during the development of the image. The bias voltage is further such that it will not prevent the insulating toner of the developer De from electrostatically adhering to the surface portions of the drum 1 corresponding to the image areas of the latent image. Accordingly the insulating toner and the magnetic carrier are electrostatically deposited on the surface of the drum 1 in corresponding relation to the image areas and the background areas of the latent image, respectively, for developing the image. In the present embodiment, the carrier is deposited on the surface of the drum 1 on the background areas of the latent image in an amount of 0.05 mg/cm$^2$. It is preferable that the developing bias voltage, which is suitably determined in accordance with the potential of the latent image, etc., generally be of the same polarity as the latent image and have a voltage value about 50 to 120 V higher than the potential of the background areas of the latent image. In connection with the electrostatic deposition of the magnetic carrier on the surface of the drum 1, it has been found that it is also necessary that when the carrier is brought into frictional contact with the insulating toner, the carrier itself be triboelectrically charged with the same polarity as the latent image and that it retain the charge, in addition to triboelectrically charging the toner with the polarity opposite to that of the latent image. To assure this, the carrier must have a resistivity of at least $10^{13}$ ohm-cm.

After the magnetic carrier and the insulating toner of the two-component magnetic developer De are deposited electrostatically on the drum surface when developing the latent image as described above, the developer other than that transferred to copy paper P is recovered by the cleaner 8 and guided into the magnetic brush developing unit 5. Consequently substantially only toner is used for developing the latent image. To replenish the developer De with toner, a toner tank 13 containing a toner supply To is provided on the developing unit 5 for causing the toner To to fall into the unit 5 when desired at the same rate as the consumption of the toner.

The transfer charger 6 is preferably a d.c. corona discharge unit having the same polarity as the latent electrostatic image for selectively transferring to the surface of the transfer paper P only the insulating toner adhering to the surface portions of the drum 1 corresponding to the image areas of the latent image and contained in the two-component developer De which has been electrostatically deposited on the surface of the drum 1 by the development of the image. To avoid the adhesion of the magnetic carrier to the surface of the paper P, it has been found to be necessary that the carrier still retains the charge of the same polarity as the latent image during the transfer. Thus the carrier must have a resistivity of at least $10^{13}$ ohm-cm as required above. Insofar as the magnetic carrier retains such charge, the carrier is electrostatically repelled toward the surface of the drum 1 by the discharge action of the transfer charger 6 without any likelihood of transfer to the surface of the paper P. To ensure satisfactory transfer of the insulating toner to the surface of the paper P, it is desired that the carrier particles have an average particle size in the range of 10 to 30 $\mu$m. However, the particles of the carrier must of course be slightly larger than the toner particles.

The copy paper P is fed to the transfer station by a feed roller 14 in synchronism with the rotation of the drum 1, has the insulating toner transferred to its surface from the drum surface, is then passed through a fixing unit 15 for thermally fixing the toner to the paper, and is thereafter delivered onto a tray 16 outside the main body of the copying machine. Since only the insulating toner adhering to the surface of the drum 1 in corresponding relation to the image areas of the latent image is transferred to the surface of the paper P, as already stated, there is no likelihood that the copy image formed on the paper will be smudged by the carrier.

The cleaner 8 is adapted to remove and recover from the surface of the drum 1 the two-component magnetic developer De remaining thereon after the toner has been transferred to the surface of the paper P, i.e. the portion of toner remaining on the drum and in excess of the toner transferred to the paper P and the magnetic carrier deposited on the surface portions of the drum 1 corresponding to the background areas of the latent image. The cleaner 8 has a cleaning blade 17 for scraping the excess of toner and the carrier from the drum surface and a collector for receiving the removed material. The collector 17*a* has a developer passing opening 18 communicating, via a developer recycling channel 19, with a developer receiving opening 20 in the developing unit 5. The developer De recovered by the cleaner 8 is transported through the channel 19 into the developing unit 5.

Figure 2:
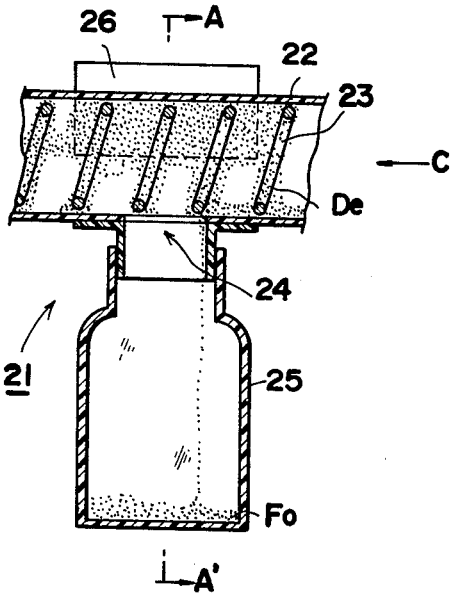
FIG. 2 is a sectional view schematically showing the construction of a foreign matter removing assembly according to the invention.
Figure 3:
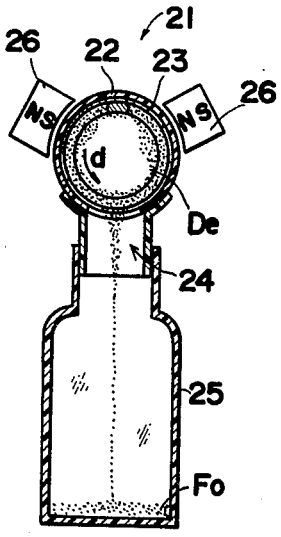
FIG. 3 is a section taken along the line A—A' in FIG. 2.

The developer recycling channel 19 includes a foreign matter removing assembly 21 which will be described in detail later with reference to FIGS. 2 and 3. The assembly 21 removes foreign matter from the developer De which is transported through the recycling channel 19 in the direction of arrow c so that the magnetic carrier and only the portion of insulating toner which is suitable for developing latent images are transported into the developing unit 5. The recycling channel 19 comprises a developer guide pipe 22 and a developer transport spring 23 as will be described below.

The foreign matter removing assembly 21 will now be described with reference to FIGS. 2 and 3. FIG. 2 shows schematically and in section the construction of the assembly 21.

In the specific embodiment shown, the developer guide pipe 22 is made of nonmagnetic material, e.g. polyester resin, has a diameter of 17 mm and serves as a guide member along which the developer De recovered by the cleaner 8 is transported into the developing unit 5. The developer transport spring 23 is made of magnetic material, e.g. iron, has a diameter of 15 mm and is disposed within the pipe 22. The spring is formed from an iron wire 1 mm in diameter by winding the wire at a pitch of 11 mm and is rotated by unillustrated drive means at 44 r.p.m. in the direction of arrow d, whereby the developer De within the pipe 22 is transported in the direction of arrow c, i.e. toward the developing unit 5.

At least part of the length of the pipe 22 is disposed in an approximately horizontal position and has a foreign matter removal opening 24 formed in the lower wall of the horizontal portion. A container 25 for receiving foreign matter Fo falling under gravity is removably attached to the pipe 22 below the opening 24. The foreign matter Fo falling through the opening 24 is collected in the container 25. The container 25 is preferably made of transparent plastic. Above the opening 24 are magnets 26 fixed to the outer periphery of the pipe 22. These magnets 26 produce a magnetic force on the inner wall surface of the pipe 22 of at least 800 G, e.g. 1000 G. The magnets 26 form a magnetic field for attracting the magnetic carrier contained in the portion of the magnetic developer De moving past the opening 24 upwardly in the horizontal portion of the pipe 22. The magnets 26 are arranged on the opposite sides of the pipe 22 with different poles opposed to each other.

The foreign matter removing assembly 21 having the above described construction operates for removing the foreign matter Fo in the following manner based on the principle described below. The two-component magnetic developer De recovered by the cleaner 8 is transported in the direction of arrow c by the rotation of the spring 23. The developer De contains foreign matter Fo including dust, such as fibers of the copy paper P, and toner particles which are not suited for developing latent electrostatic images. To prevent the toner particles suitable for developing latent electrostatic images from inadvertantly falling into the container 25 during the removal of foreign matter, the amount of magnetic carrier deposited on the drum surface is so adjusted in the present embodiment that the proportion by weight of the carrier in the developer De recovered by the cleaner 8 will exceed the amount of the toner contained therein. The chief way of carrying out this adjustment is to adjust the value of the developing bias voltage.

The small size particles of magnetic carrier in the developer De brought into the magnetic field of the magnets 26 while being transported in the direction of arrow c are magnetically attracted to the inner wall surface of the pipe 22 provided with the magnets 26 or to the magnetized spring 23, and are thus passed over the opening 24 without falling through the opening 24, and are transported into the magnetic brush developing unit 5. Thus, the particles of carrier are transported into the unit 5 by being magnetically separated.

When the magnetic carrier particles are magnetically attracted to the inner wall surface of the pipe 22 or to the magnetized spring 23, the particles of insulating toner which are useful for developing latent images, i.e. which are charged with a polarity opposite to that of the latent image, are electrostatically attracted to the carrier particles and are similarly transported into the developing unit 5 with the carrier particles. Thus the portion of toner suitable for developing latent images is transported into the unit 5 along with the particles of magnetic carrier.

However, the foreign matter Fo is not magnetic in itself, nor is it sufficiently charged to be electrostatically attracted to the particles of magnetic carrier, so that the foreign matter Fo will not be magnetically attracted to the inner wall surface of the pipe 22 or to the magnetized spring 23, nor will it be electrostatically attracted to the magnetic carrier. Consequently, when the developer De is transported in the direction of arrow c, the foreign matter Fo is moved along the inner wall surface of the lower portion of the pipe 22 and falls into the container 25 through the opening 24, whereby the foreign matter Fo is separated and collected. As a result, only the magnetic carrier and the portion of the toner which is useful for developing latent images are transported into the developing unit 5.

Because the spring 23 is drivingly rotated in the magnetic field set up by the magnets 26 and also because the spring 23 is made of magnetic material, the magnetic field has markedly varying local forces. The small particles of magnetic carrier in the magnetic field are therefore subjected to a great physical force to undergo a vigorous motion, with the result that the particles of foreign matter Fo which are simply adhering to the carrier particles are effectively separated therefrom and fall into the container 25. This permits the assembly 21 to achieve a high efficiency in the removal of foreign matter.

In the electrographic copying machine of the powder image transfer type including the invention as described above, the physical properties of small particles of magnetic carrier are ingeniously utilized for efficiently removing foreign matter from the insulating toner recovered by a cleaner when the toner is transported into a magnetic brush developing unit. The machine therefore has the advantage that although the recovered toner is reused for developing latent electrostatic images, the copy images produced are free from noise that would otherwise result from the presence of foreign matter in the toner.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A powder image transfer type electrographic copying machine which comprises:

an image bearing member;

a magnetic brush developing unit having a developing electrode in its interior and a magnetic developer which is a mixture of a finely divided substantially non-magnetic toner having insulating properties and a finely divided magnetic carrier having particles of a size sufficiently small to be transferable to the image bearing member with the toner and a resistivity of at least $10^{13}$ ohm-cm for developing a latent electrostatic image on the surface of the image bearing member, said toner being of a type which is triboelectrically charged with a polarity opposite to that of the latent electrostatic when brought into frictional contact with said magnetic carrier;

a developing bias voltage source for applying to the developing electrode a developing bias voltage sufficient for electrostatically depositing the magnetic carrier of the magnetic developer on the surface of the image bearing member in the background area of the latent electrostatic image during the development of the latent image;

a toner image transfer unit for selectively transferring to the surface of a copy sheet only the insulating toner adhering to the surface of the image bearing member in corresponding relation to the image area of the latent image and contained in the magnetic developer electrostatically deposited on the surface of the image bearing member by the development of the latent image;

a cleaner for removing and recovering from the surface of the image bearing member the magnetic developer remaining on the surface after the transfer of the insulating toner;

a nonmagnetic hollow cylindrical member extending from said cleaner to said magnetic brush developing unit for transporting the magnetic developer recovered by the cleaner into the magnetic brush developing unit and having at least a portion thereof disposed in an approximately horizontal position;

the lower wall of the approximately horizontal portion of the hollow cylindrical member having a foreign matter removal opening therein;

a magnetic transport member disposed within said hollow cylindrical member for moving the magnetic developer through said hollow cylindrical member toward the developing unit; and a magnet means structurally associated with said cylindrical member for forming a magnetic field in said cylindrical member for attracting the magnetic carrier contained in the portion of the magnetic developer located in the vicinity of the removal opening upwardly in the hollow cylindrical member;

whereby the course of transporting the magnetic developer recovered by the cleaner toward the developing unit, foreign matter in the magnetic developer is caused to fall through the opening.

2. An electrographic copying machine as claimed in claim 1, wherein said magnetic developer has particles of magnetic carrier with in average particle size of 10 to 30 μm and the particles of insulating toner have an average particle size smaller than the average particle size of the particles of magnetic carrier.

3. An electrographic copying machine as claimed in claim 1, wherein said developing bias voltage has the same polarity as the latent electrostatic image and has a value higher than the potential of the background area of the latent image.

4. An electrographic copying machine as claimed in claim 1, wherein said toner image transfer unit comprises a d.c. corona discharge unit having the same polarity as the latent image.

5. An electrographic copying machine as claimed in claim 1, wherein said magnetic transport member comprises a magnetic coil spring which is drivingly rotatable.

* * * * *